US006428870B1

(12) United States Patent
Bohnhoff

(10) Patent No.: US 6,428,870 B1
(45) Date of Patent: Aug. 6, 2002

(54) SUBSURFACE FLUID DRAINAGE AND STORAGE SYSTEM AND MAT ESPECIALLY UTILIZED FOR SUCH SYSTEM

(76) Inventor: William W. Bohnhoff, 12501 E. Amherst Cir., Aurora, CO (US) 80014

( * ) Notice: Subject to any disclaimer, the term of this patent is extended or adjusted under 35 U.S.C. 154(b) by 0 days.

(21) Appl. No.: 09/748,292

(22) Filed: Dec. 26, 2000

(51) Int. Cl.[7] ..... B32B 3/10

(52) U.S. Cl. ..... 428/44; 428/131; 428/44; 428/52; 428/53; 428/36.9; 52/180

(58) Field of Search ..... 404/35, 36, 41; 428/131, 44, 36.9, 52, 53; 52/180

(56) References Cited

U.S. PATENT DOCUMENTS 5,250,340 A 10/1993 Bohnhoff ..... 428/99

*Primary Examiner*—Harold Pyon
*Assistant Examiner*—Jane Rhee

(57) ABSTRACT

Tubular segments may be nestably interconnected, with the lower end of one tubular segment compressively inserted into the upper end of another tubular segment. A mat formed of such tubular members, and a fluid storage system formed of a plurality of such vertically stacked mats, are also disclosed.

20 Claims, 9 Drawing Sheets

SUBSURFACE FLUID DRAINAGE AND STORAGE SYSTEM AND MAT ESPECIALLY UTILIZED FOR SUCH SYSTEM

The present invention generally relates to systems for subsurface fluid drainage and storage, and more particularly to a system and method for vertically stacking in a nested relation an apparatus especially suited for promoting, directing, and storing rain and irrigation water drainage on and/or below the land's surface.

Most of the subsurface fluid and drainage and storage systems known are variations on a fundamental concept of providing lateral drainage through one or more layers of sorted gravel or crushed rock. In the typical known system, a layer of gravel underlies the smaller-particle root zone beneath the upper surface of soil. Water passing through the root zone reaches the gravel layer, and then presumably flows laterally through the gravel layer to a perforated pipe or French drain for discharge into a nearby surface watercourse or into a storm sewer system. Known systems however, are vulnerable over time as the gravel settles into an ever more densely packed layer. As fine sand filters down and fills voids in the gravel, the gravel layer's fluid transmissivity is adversely affected. Additionally, gravel's tendency to settle reduces the desirability of placing pipes within a gravel layer, as severe settling and compaction may lead to pipe rupture.

U.S. Pat. Nos. 5,250,340; 5,102,048; 5,848,856; and 5,123,778, the entire disclosures of which are hereby incorporated by reference, disclose additional systems that generally relate to the drainage and storage of fluid.

SUMMARY OF THE INVENTION

A subsurface fluid drainage and storage system with high void storage volume that is placed in compression, instead of bending or tension, that provides for very high loading. The dranage and storage system preferably is comprised of one or more mats nestably stacked upon each other. Each mat comprises crush-resistant support members each possessing a substantially open receiving end located near the top of the support member, a substantially open compression fitting located near the bottom of the support member, a plurality of ribs extending longitudinally along the inner sidewall of the support member, and at least one peripheral wall opening extending upward longitudinally from the bottom of the compression fitting and terminating above the compression fitting. The support members are held in spaced relation to one another by interior struts such that the interior struts and the support members define a grid. An exterior strut, operatively connected to at least one support member extends along the perimeter of the grid to provide added support. The compression fitting allows the mats to be vertically stacked in a nested relation and thereby provides increased strength against lateral forces, relatively compact construction, larger storage volume, ease of transport, and ready installation. Additionally, the system may be encased by an impervious liner to allow the system to store water.

There has thus been outlined certain features of the invention in order that the detailed description that follows may be better understood. There are additional features of the invention that will be described which will form the subject matter of the claims appended. It is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for the purpose of description and should not be regarded as limiting. As such those skilled in the art will appreciate that the conception, upon which this disclosure is based, may readily be utilized as a basis for the designing of other structures, methods, and systems for carrying out the several purposes of the present invention. It is important therefore, that the claims be regarded as including such equivalent constructions insofar as they do not depart from the spirit and scope of the present invention.

DETAILED DESCRIPTION OF THE PREFERRED EMBODIMENTS

Figure 1:
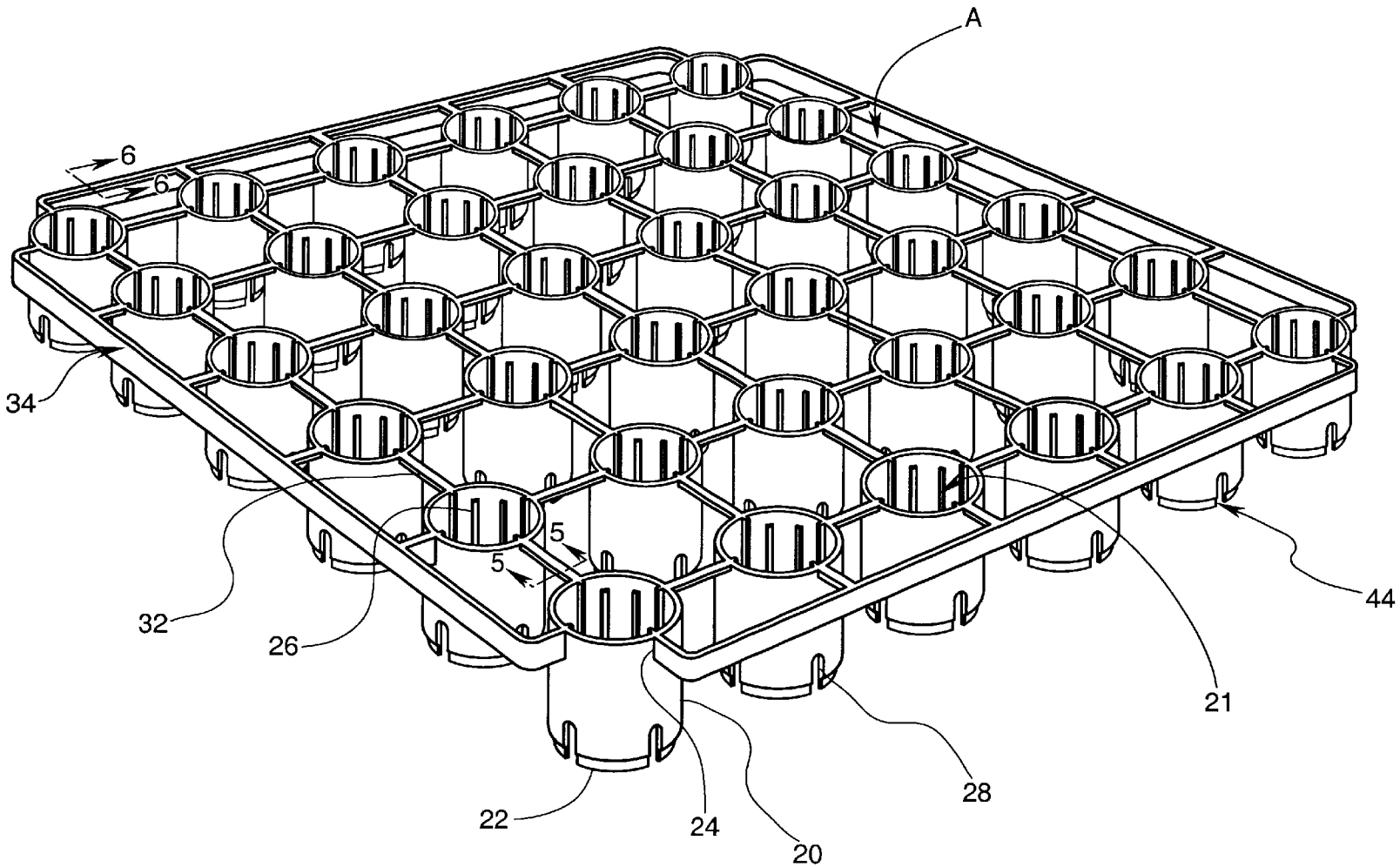
FIG. 1 is a perspective view of a preferred embodiment of the invention.
Figure 2:
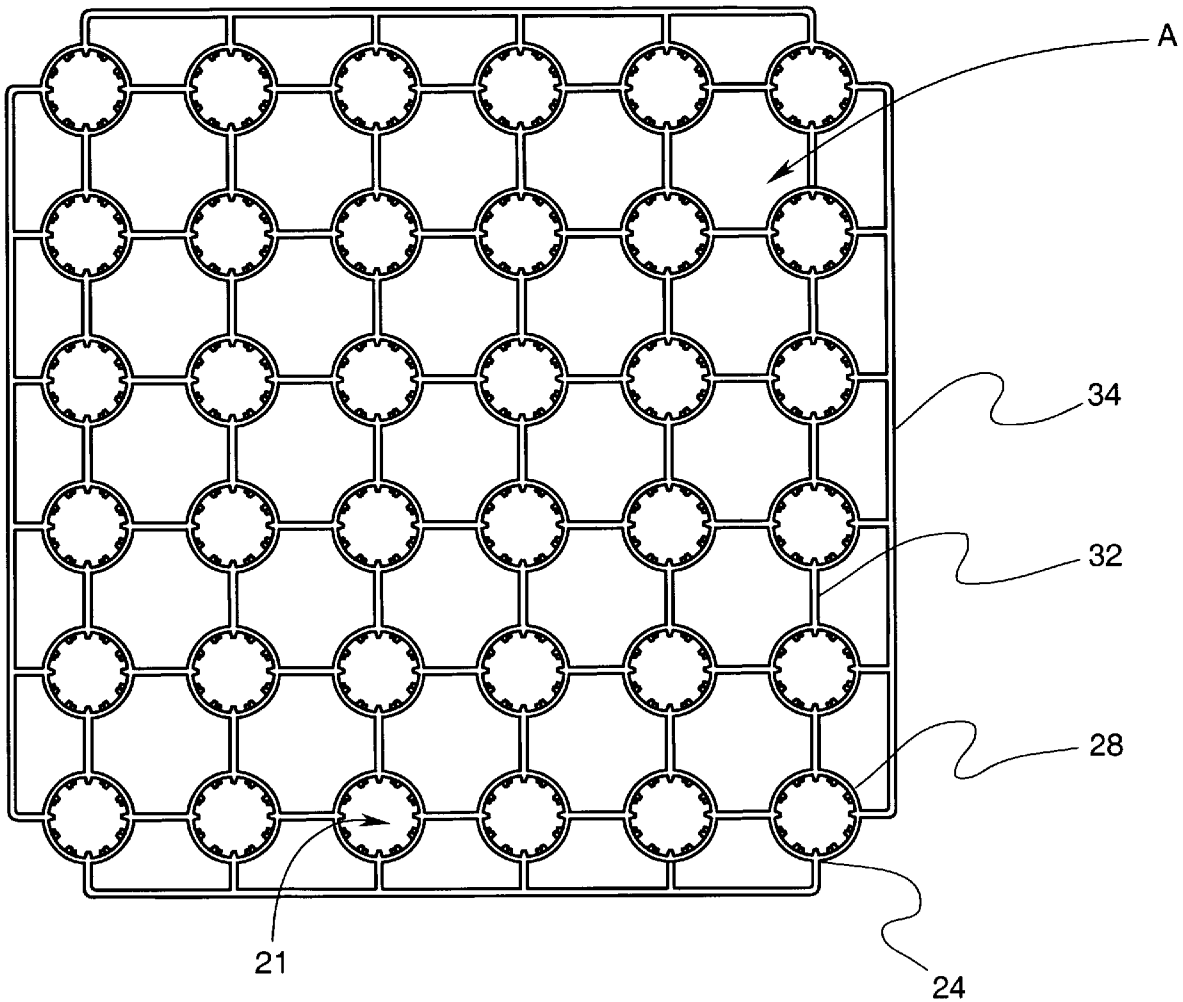
FIG. 2 is a top view of the preferred embodiment of the invention shown in FIG. 1.

In the drawings, like reference numerals designate corresponding structure throughout the views.

The present invention generally relates to a mat for subsurface fluid drainage and storage in which the mat is placed in compression and whereby a plurality of mats may be vertically, nestably stacked and thereby provide increased strength against lateral forces, relatively compact construction, larger storage volume, ease of transport, and ready installation. As a setting for the following discussion, the preferred form of the invention will be described for use in collecting and storing water, however, it will be readily appreciated that aspects of the invention will be conformable with other uses of collecting and storing liquids and even gases.

The improved system for subsurface fluid drainage and storage involves a comparatively simple and inexpensive gravity flow system which reduces the amount of time excess water spends in the soil. In the practice of a preferred embodiment of the invention, water percolates only about 30.0 to about 45.0 cm. vertically down through the root zone before entering a physical drainage structure and then being transported to a collector pipe. Known subsurface systems typically require water to travel a meter or more vertically and/or horizontally before encountering a drain pipe from which effective drainage may occur.

Referring to the drawings in more detail, there is illustrated in FIGS. 1 to 4 a preferred form of the invention that utilizes a mat A comprised of an array of support members 20 that each preferably possess a substantially open receiving end 21, a substantially open compression fitting 22, one or more stiffening ribs 24, one or more support ribs 26, and at least one peripheral wall opening 28. Each support member 20 preferably comprises a thin-walled cylindrical column integrally molded from a semi-rigid thermoplastic material, and for best results, a high impact polypropylene or high density polyethylene plastic. Additionally, it should be noted that support members of other than cylindrical shape may be used, for instance, oval, hexagonal, rectangular, square, triangle, octagonal, or other cross-sectional may be utilized.

Figure 3:
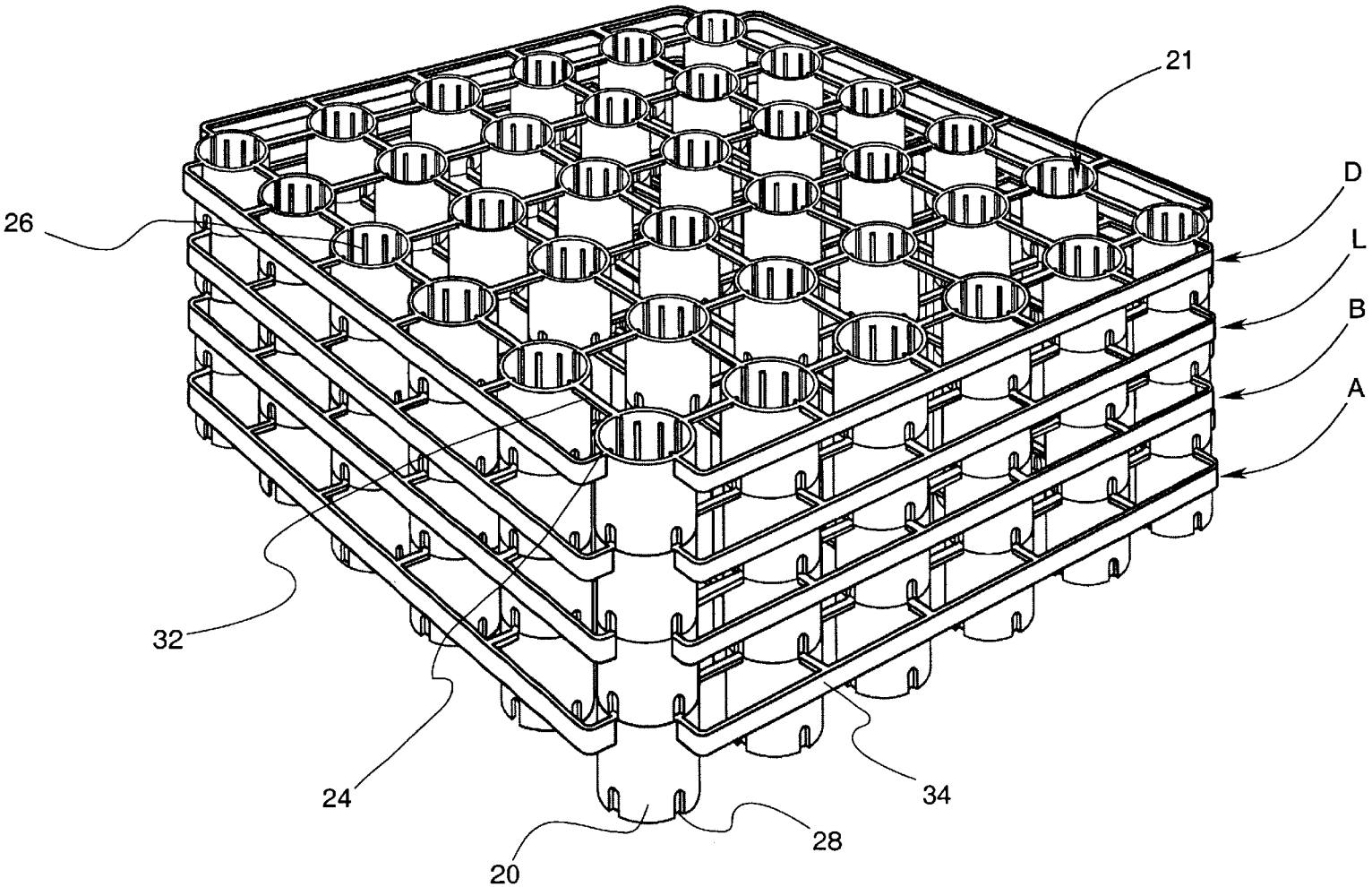
FIG. 3 is a perspective view of multiple embodiments of the invention shown in FIG. 1 in a stacked nested relation.
Figure 7:
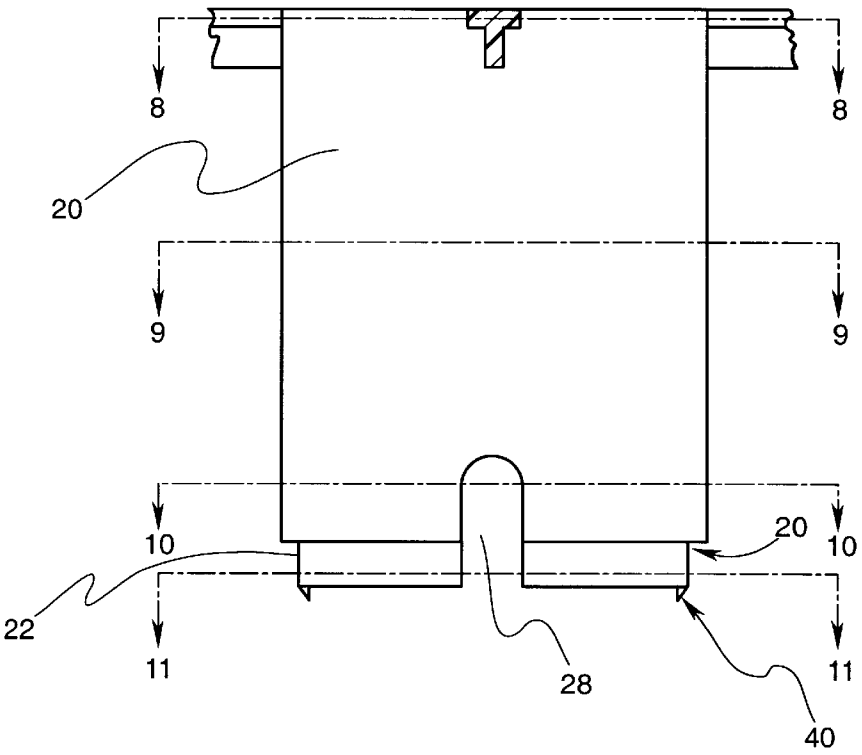
FIG. 7 is a side view of one of the support members in the embodiment shown in FIG. 1.
Figure 12:
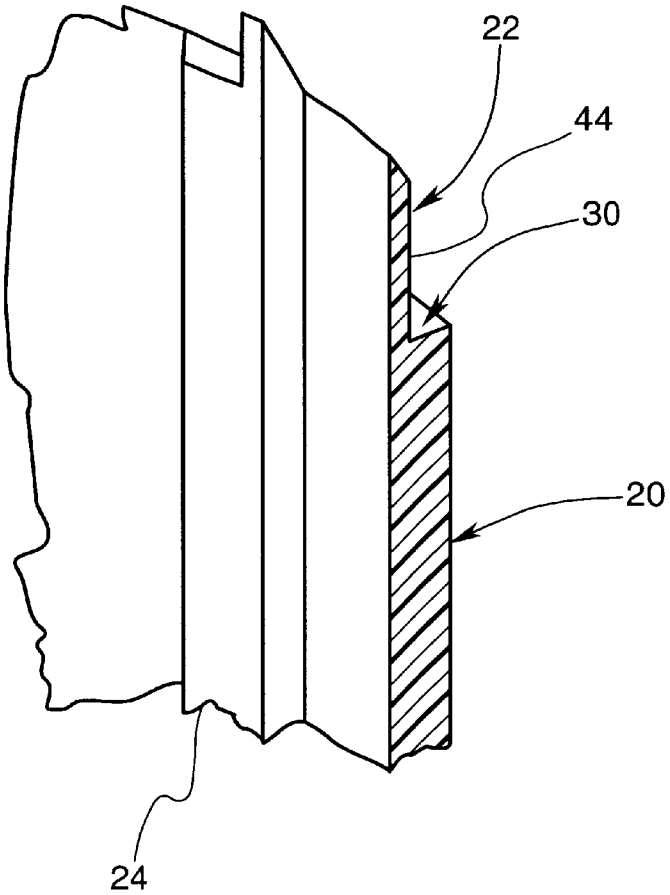
FIG. 12 is a fragmental cross sectional view of the support member shown in FIG. 7.

Referring now to FIGS. 7 and 12, The compression fitting 22 of a support member of an upper mat preferably is designed to be axially inserted into the receiving end 21 of a support member of a lower mat such that the support members may be stacked in a nested relationship. The compression fitting 22 is located near the bottom of the support member 20 and extends around the perimeter of the support member 20 and longitudinally upwards to preselected distance, preferably about one to one and one-half centimeters, however, for best results the compression fitting 22 should not extend longitudinally higher than the peripheral wall opening 28. Additionally, the compression fitting 22 possesses a smaller outside perimeter than the receiving end 21 and preferably possesses a beveled edge to allow the support member 20 to be stacked in a vertical nested relation. A plurality of eight equal angular spaced fingers 40, help align the compression fitting 22 during its insertion with the receiving end 21 of a lower support member, extend below the compression fitting 22 and are preferably beveled to allow the compression fitting 22 to be easily axially inserted into the receiving end 21 of another support member 20, as is illustrated in FIG. 3.

Figure 13:
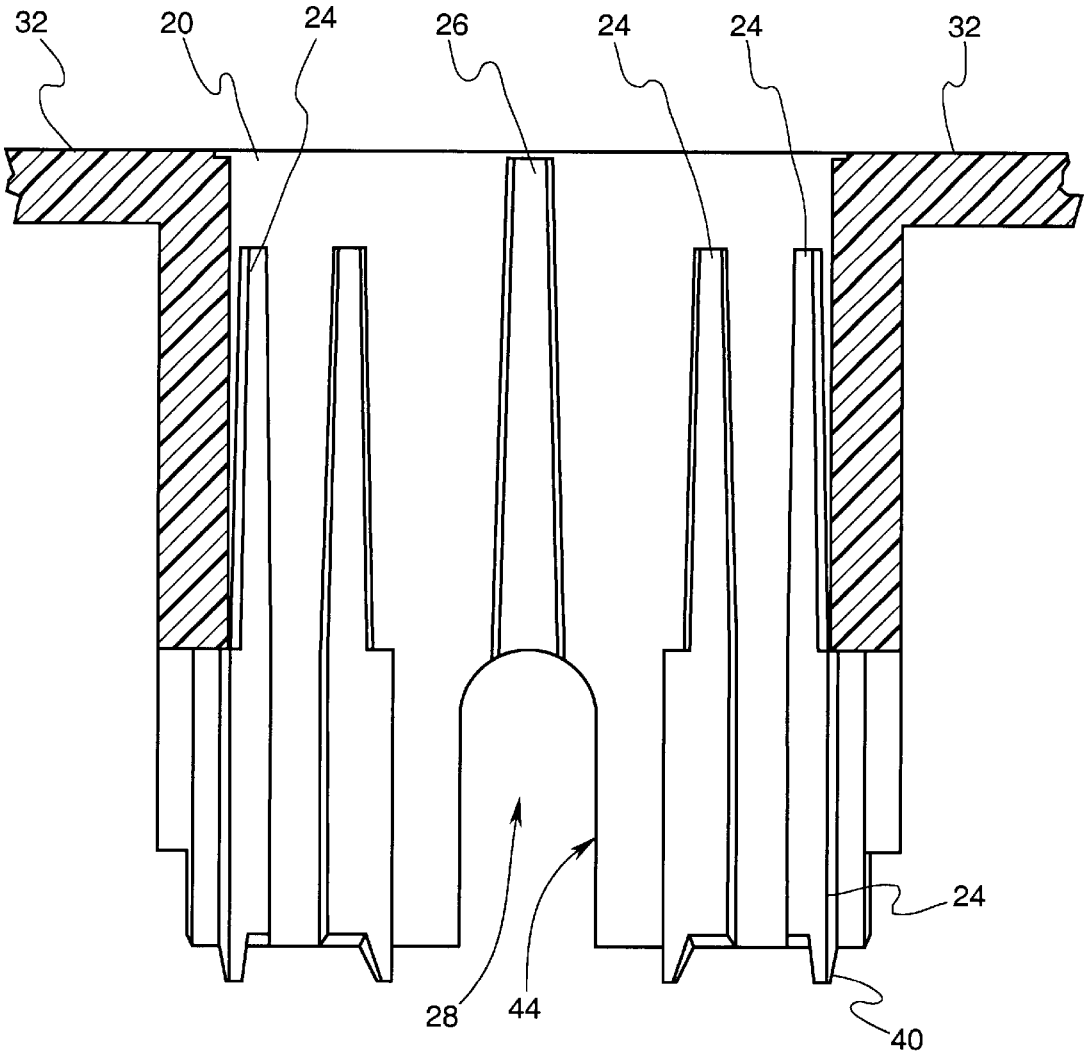
FIG. 13 is a cross-sectional view of one of the tubular members shown in FIG. 1.
Figure 14:
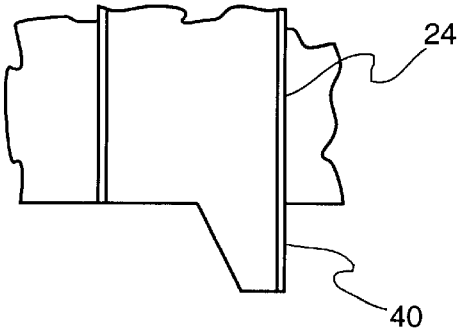
FIG. 14 is a zoom view of one of the fingers shown in FIG. 13.
Figure 15:
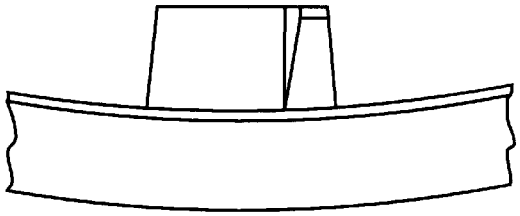
FIG. 15 is a longitudinal cross sectional view of the support member shown in FIG. 7.

Referring now to FIG. 13, which is a longitudinal cross-sectional view of one of the support members 20, four equally angular spaced support ribs 26 are longitudinally disposed on the interior side of the support member 20 and extend longitudinally from approximately the receiving end 21 to approximately the top of an associated peripheral wall opening 28. For best results, the support rib 26 should be located on the interior wall at approximately the same position as where the struts, either internal or external, terminate on the outside wall of the support member 20. The support ribs 26, may in fact be operatively connected or integrally formed with the internal 32 or external struts 34. Additionally, as best shown in FIG. 13 the support rib 26 widens gradually from the top of the support member 20, however, this illustration is not intended to limit the size and shape of the support rib 26. FIG. 13 also shows eight stiffening ribs 24 which begin below the receiving end 21 and extend past the compression fitting 22, terminating with a corresponding finger 40. Preferably, the upper end of the stiffening ribs 24 is recessed from the receiving end 21 a distance approximately equal to, or at least as high as, the height of the compression fitting 22. Such dimension will allow the compression fitting to be totally insertable into the receiving end, prevent the compression fitting from being inserted too deeply, allow the stacked mats to be in nested relation, and aid in the formation of a rigid, stable structure.

The stiffening ribs 24 are double in thickness below a point approximately even with the upper end of the peripheral wall openings 28. It should be noted that the stiffening ribs 24 are not required to double in size, and this dimension is not intended to limit the invention. Each stiffening rib 24 terminates in a corresponding finger 40 that is preferably beveled to allow for ease in axially inserting the compression fitting 22 into the receiving end 21 of another support member. The fingers 40 extend below the compression fitting 22, and once axially inserted, aid in preventing the support member 20 from rotating with respect to mated support member. Additionally, four equal angularly spaced peripheral wall openings 28 in the compression fitting 22 cooperates with the four corresponding support ribs 26 of the lower support member to help prevent the matrix from rotating. Preferably, the support member 20 will possess four peripheral wall openings 28, that roughly divide the compression fitting 22 into four quadrants. Each quadrant preferably has two stiffening ribs 24 extending down and terminating into fingers 40 that extend below the compression fitting 22 and the support member 20. Preferably, the fingers 40 in each quadrant oppose each other as shown in FIG. 13.

Referring now to FIGS. 1 and 12, preferably the compression fitting 22 possesses the same inside perimeter as the support member 20 and the receiving end 21. However, the outside perimeter of the compression fitting 22 is smaller than the outside perimeter of the receiving end 21, whereby a shelf 30 is created that will aid in stabilizing the support member 20 when vertically stacked. Please note that FIG. 12, as shown, has inverted the illustration such that the compression fitting 22 appears towards the top of the drawing. In another preferred embodiment, the outside perimeter of the compression fitting 22 will approximately equal the outside perimeter of the support member 20 at the top of the compression fitting 22, but will taper inwardly towards the bottom of the compression fitting 22 such that the outside perimeter at the bottom of the compression fitting 22 is smaller then the outside perimeter at the top of the compression fitting 22. The peripheral wall openings 28, allow water to flow through the support members in two perpendicular directions, laterally through each support member while the open interior of the support members and the spacing of the support members allows water to flow vertically through and between the support members and laterally between the support members.

Figure 5:
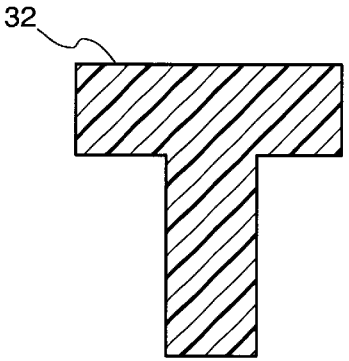
FIG. 5 is a cross section view of an interior strut in the embodiment shown in FIG. 1 taken along the line 5—5.
Figure 6:
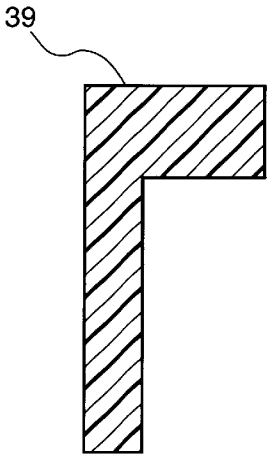
FIG. 6 is a cross section view of an exterior strut in the embodiment shown in FIG. 1 taken along the line 6—6.

Referring back to FIGS. 1 and 2, there is shown a plurality of support members 20 disposed in a uniform rectangular array defined by a plurality of perpendicular rows and columns defining the mat A. Internal struts 32 operatively connected or preferably integrally molded to the support members 20 provide added strength to resist external and/or lateral soil and water pressure. For best results the internal struts 32 should be T-shaped beams, as shown in FIG. 5. An external strut 34 is operatively connected or preferably integrally molded with a support member 20 located at the corner of mat A. As illustrated, the external strut 34 extends along one perimeter side of mat A, and is connected to support members 20 located at the corners of mat A. The external strut 34 may either be connected to mat A at the corner support members 20, may be operatively connected or integrally molded directly to the outside wall of each support member 20 located on that perimeter side, or for best results, the external strut 34 should be operatively connected or integrally molded to every support member 20 along the perimeter side by an internal strut 32 that extends outward from each support member 20, as shown in FIG. 1. For best results the external strut should be an L-shaped beam, as shown in FIG. 6.

Figure 9:
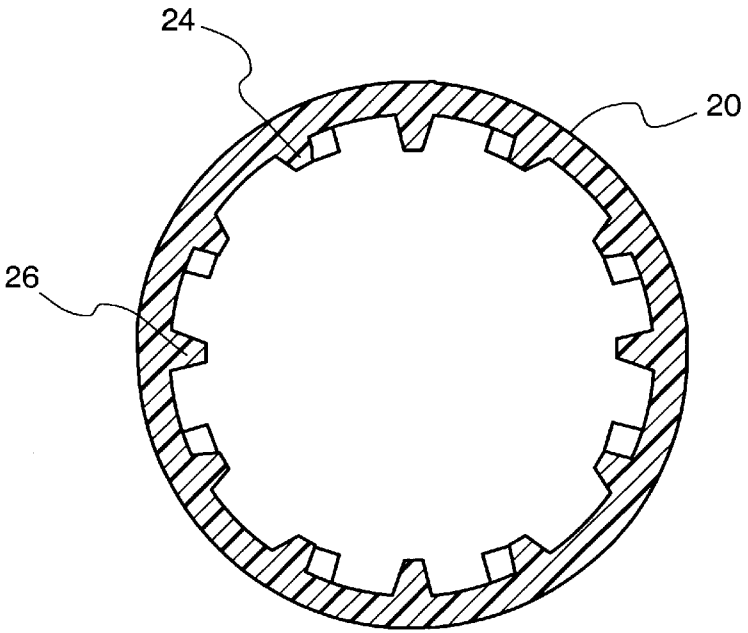
FIG. 9 is a cross sectional downward view of the support member shown in FIG. 7, taken along the line 9—9.
Figure 8:
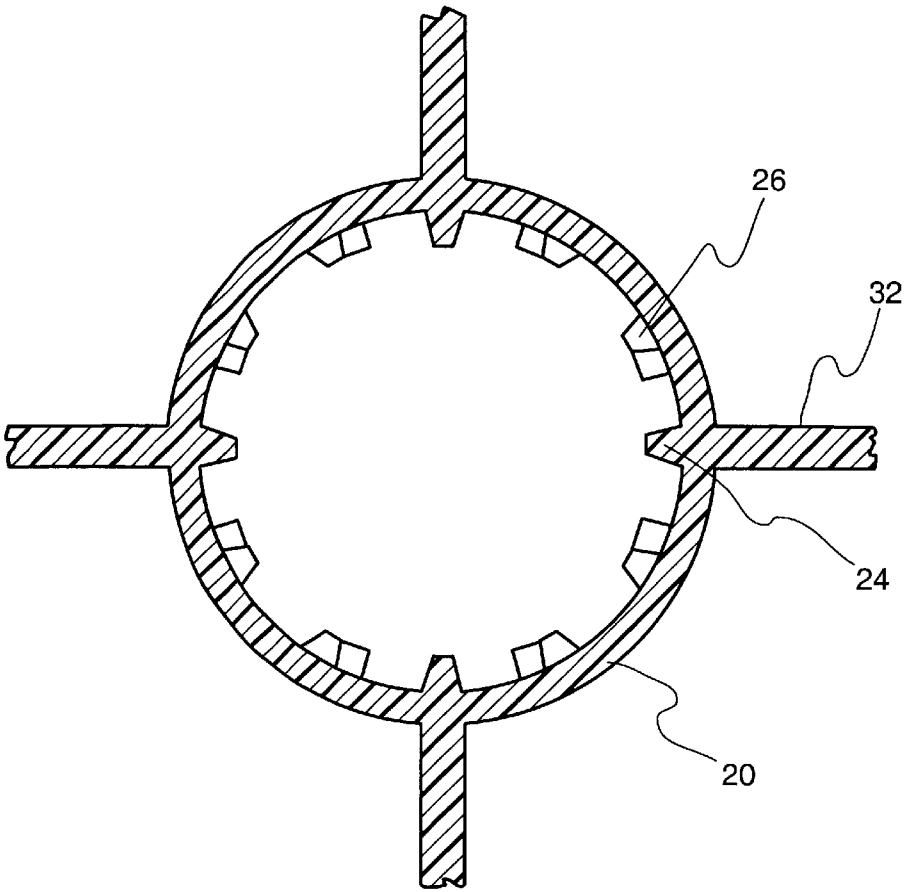
FIG. 8 is a cross sectional downward view of the support member shown in FIG. 7, taken along the line 8—8.
Figure 11:
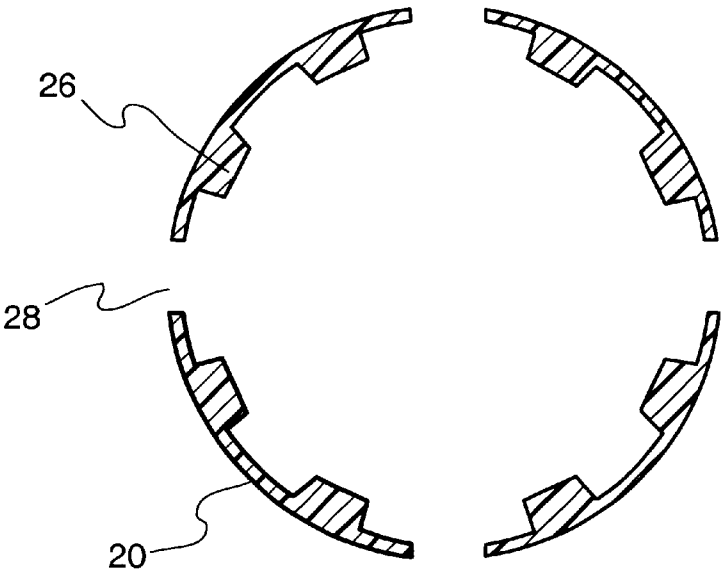
FIG. 11 is a cross sectional downward view of the support member shown in FIG. 7, taken along the line 11—11.
Figure 10:
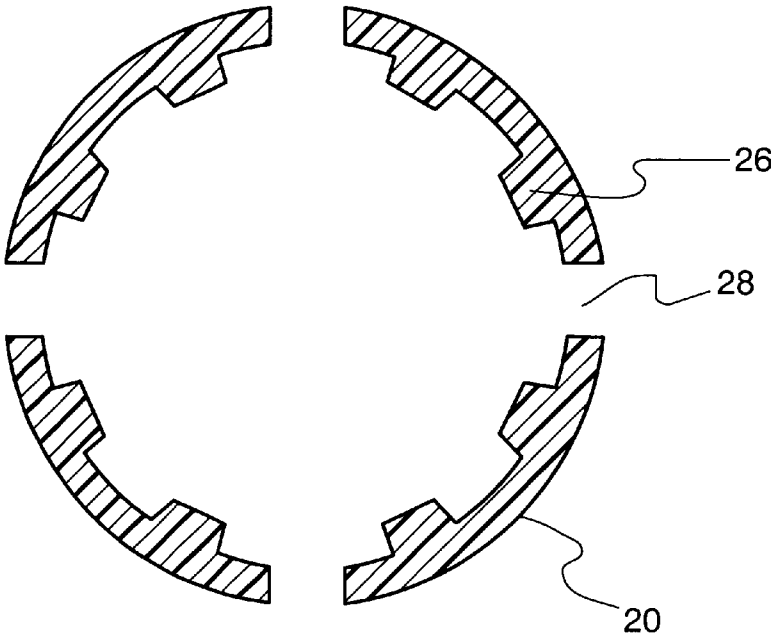
FIG. 10 is a cross sectional downward view of the support member shown in FIG. 7, taken along the line 10—10.

The peripheral wall opening 28 extends longitudinally upward from the bottom of the compression fitting 22 to a point approximately equal to or above the compression fitting 22. Preferably, there are four openings disposed at ninety degree angular intervals positioned under a corresponding support rib 26. The sides of each peripheral wall opening 28 preferably extend longitudinally and parallel to each other, with the upper end of each peripheral wall opening 28 being preferably rounded or actuated. The peripheral wall openings 28 divide the compression fitting 22 into four quadrants, whereby each peripheral wall opening 28 is separated from another peripheral wall opening 28 by two stiffening ribs 24. The stiffening ribs 24 and the support ribs 26 provide strength and rigidity to the support member 20, extend longitudinally along the inner sidewall of each support member 20, and are operatively connected or preferably integrally molded to the support member 20. Preferably, eight stiffening ribs 24 and four support ribs 26 extend along the inner sidewall of the support member 20. As illustrated in FIGS. 8 and 9, the support ribs 26 are disposed at ninety degree angular intervals. The stiffening ribs 24 are preferably disposed between support ribs 26 such that there is a thirty degree angular interval between each stiffening rib 24 and between a stiffening rib 24 and a support rib 26. Both the stiffening rib 24 and the support rib 26 are preferably frustoconical in shape.

FIG. 3 illustrates a plurality of mats in stacked, nested relation. For reference these mats are labeled mat A, mat B, mat C, and mat D. Each mat is preferably substantially identical to each other mat and is constructed according to the principles outlined above. As has been illustrated, the substantially open receiving end 21, is adapted to receive the compression fitting 22 of the support member directly above. For example, the compression fittings of mat B are axially inserted into the substantially open receiving end support member of mat A. It should be noted that only four mats are illustrated in stacked, nested relation for the purposes of illustration, not limitation.

Figure 4:
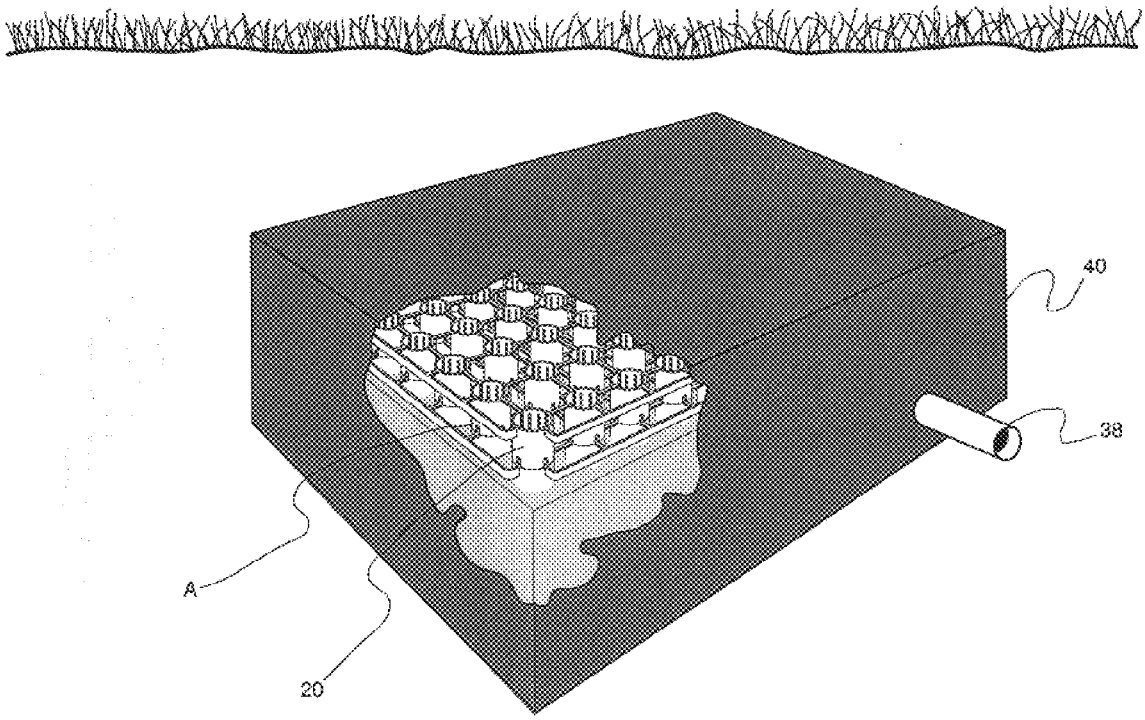
FIG. 4 is an illustration of a preferred form of the invention shown in FIG. 1 enclosed in a liner for subsurface disposition.

Referring now to FIG. 4, one or more sheet layers 42 may be secured to or placed over the face of the stacked, nested mats. For example, one or more layers 42 may be sealingly wrapped over the sides, bottom, and top of the stacked mats to allow the mats to be used to store fluids. Preferably, the sheet layers 42 are geotextile materials and/or geomembranes, and or skeletal layers in accordance with the disclosure of U.S. Pat. No. 4,896,993, which is hereby incorporated by reference although the layers 42 may be liquid or gas impermeable. A sheet layer 42 may be applied to the bottom surface of the mat A, and the upper ends of the support members 20 inserted downwardly into a ground surface for purposes for erosion control. The upper sheet layer would then provide a stabilized surface for vehicles or pedestrian traffic or establishment and/or protection of vegetation. The mats also provide additional support for the layer 42 because the internal and external struts provide additional supporting contact points. One or more drain pipes 38 may also be used to control the in flux or evacuation of water from the structure. This construction results in the formation of voids within and passages between the support members, and also in the exclusion of particulate material from the integral structure between the mats. It is contemplated that this embodiment would be utilized in construction applications to form drainage passages, or storage containers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A tubular segment having a substantially longitudinal axis and arranged for nestable interconnection with another essentially identical tubular segment, whereby when said tubular segment is nestably interconnected with another essentially identical tubular segment, both said tubular segments are substantially aligned along said longitudinal axis, said tubular segment including:

(a) an upper end and a lower end, said lower end being configured to longitudinally extend into the upper end of another essentially identical tubular segment;

(b) a plurality of spaced ribs longitudinally extending along the interior wall of said tubular segment, the upper ends of each said rib arranged to abut the lower end of an essentially identical tubular segment nestably interconnected therewith; and (c) a plurality of spaced fingers extending below said lower end, each finger adapted to engage a corresponding rib whereby rotation of said tubular segment relative to another essentially identical tubular segment nestably interconnected therewith about said longitudinal axis is substantially prevented.

2. A tubular segment according to claim 1 wherein each of said fingers possesses a beveled distal end.

3. A tubular segment according to claim 1 wherein said tubular segment possesses a substantially cylindrical shape and wherein said ribs are substantially equiangularly spaced about said longitudinal axis of said tubular segment and wherein said fingers are substantially equiangularly spaced about said longitudinal axis of said tubular segment.

4. A tubular segment according to claim 1 wherein said fingers, said ribs, and the remainder of said tubular segment are essentially integrally formed of a plastic material.

5. A tubular segment according to claim 1 wherein said tubular segment possesses a substantially cylindrical shape, with a substantially cylindrical outer peripheral surface and a substantially cylindrical inner peripheral surface, the lower end of said tubular segment possessing a recessed collar portion forming an annular lip, said collar portion arranged to extend into the upper end of an essentially identical tubular segment such that said annular lip abuts the upper end of the essentially identical tubular segment and limits the longitudinal extension of the lower end of said tubular segment into the upper end of the essentially identical tubular segment.

6. A tubular segment according to claim 5 wherein the outer peripheral diameter of said collar portion is slightly greater than the inner peripheral diameter of the upper end of said tubular segment such that when said collar portion extends into the upper end of an essentially identical tubular segment, said collar portion compressively flexes radially inwardly.

7. A tubular segment according to claim 5 wherein the lower edge of said collar portion is tapered.

8. A tubular segment according to claim 6 wherein the outer peripheral diameter of said collar portion is about one-quarter percent to three percent greater than the inner peripheral diameter of the upper end of said tubular segment.

9. A tubular segment according to claim 5 wherein the longitudinal length of said collar portion is about one-twentieth to one-fifth of the overall longitudinal length of said tubular segment.

10. A tubular segment according to claim 1 further including at least one aperture extending from an inner peripheral surface to the outer peripheral surface of said tubular segment.

11. A tubular segment according to claim 10 wherein said tubular segment possesses a substantially cylindrical shape and where said tubular segment includes at least four said apertures substantially equiangularly spaced about said longitudinal axis of said tubular segment.

12. A tubular segment according to claim 10 wherein said aperture extends longitudinally upward from the lower end of said tubular segment.

13. A tubular segment according to claim 12 wherein said aperture extends longitudinally upward from the lower end of said tubular segment to a point longitudinally above said lip.

14. A tubular segment according to claim 13 wherein said aperture extends longitudinally upward about one-tenth to one-third of the overall longitudinal length of said tubular segment.

15. A tubular segment according to claim 12 further including a stiffening rib longitudinally extending along the interior wall of said tubular segment, longitudinally aligned with said aperture, and extending substantially to the upper end of said tubular segment.

16. A mat for creating a structurally supported region of space in which said mat is disposed, aid mat including:

(a) a substantially planar substantially quadrilateral grid formed by a plurality of substantially perpendicular struts;

(b) a plurality of upstanding substantially cylindrical tubular members spaced uniformly on said grid, each tubular member having a substantially longitudinal axis and adapted for nestable interconnection with another essentially identical tubular member, whereby when said tubular member is nestably interconnected with another essentially identical tubular member, both said tubular members are substantially aligned along said longitudinal axis, said tubular member including:

(1) an upper end and a lower end, said lower end being configured to longitudinally extend into the upper end of another essentially identical tubular member;

(2) a plurality of spaced ribs longitudinally extending along the interior wall of said tubular member, the upper ends of each said rib arranged to abut the lower end of an essentially identical tubular member nestably interconnected therewith; and (3) a plurality of spaced fingers extending below said lower end, each finger arranged to engage a corresponding rib whereby rotation of said tubular member relative to another essentially identical tubular member nestably interconnected therewith about said longitudinal axis is substantially prevented, such that a plurality of said mats is be substantially vertically stacked on top of each other, than the lower ends of each said tubular member in a higher one of said mats nestably interconnects in the associated upper ends of each said tubular member in the mat immediately therebeneath.

17. A mat according to claim 16 wherein said struts and said tubular members are essentially integrally formed of a plastic material.

18. A mat according to claim 16 wherein said tubular members are disposed in a substantially uniform rectangular array defined by a plurality of substantially perpendicular rows and columns.

19. A system adapted to store a fluid, said system including:

(a) a plurality of vertically stacked mats, each said mat including:

(1) a substantially planar quadrilateral grid formed by a plurality of substantially perpendicular struts;

(2) a plurality of upstanding substantially cylindrical tubular members spaced uniformly on said grid, each tubular member having a substantially longitudinal axis and arranged for nestable interconnection with another essentially identical tubular member, whereby when said tubular member is nestably interconnected with another essentially identical tubular member, both said tubular members are substantially aligned along said longitudinal axis, said tubular member including:

(3) an upper end and a lower end, said lower end being configured to longitudinally extend into the upper end of another essentially identical tubular member;

(4) a plurality of spaced ribs longitudinally extending along the interior wall of said tubular member, the upper ends of each said rib arranged to abut the lower end of an essentially identical tubular member nestably interconnected therewith; and (5) a plurality of spaced fingers extending below said lower end, each finger arranged to engage a corresponding rib whereby rotation of said tubular member relative to another essentially identical tubular member nestably interconnected therewith about said longitudinal axis is substantially prevented, such that a plurality of said mats may be substantially vertically stacked on top of each other, with the lower ends of each said tubular member in a higher one of said mats nestably interconnected in the associated upper ends of each said tubular member in the mat immediately therebeneath;

(b) a substantially fluid impermeable covering substantially completely surrounding said vertically stacked mats; and (c) at least one port extending through said covering whereby fluid is permitted to pass between the interior and exterior of the region substantially completely surrounded defined by said covering.

20. A system according to claim 19 wherein said fluid consists essentially of water.

* * * * *